US006694911B1

(12) United States Patent
Gallagher et al.

(10) Patent No.: US 6,694,911 B1
(45) Date of Patent: Feb. 24, 2004

(54) ENHANCED DISPLAY- UNDERWATER COMBAT SWIM BOARD

(75) Inventors: Dennis Gallagher, Panama City, FL (US); William Olstad, Panama City, FL (US); Gram Holmes, Lynn Haven, FL (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 97 days.

(21) Appl. No.: 10/117,555

(22) Filed: Apr. 5, 2002

(51) Int. Cl.[7] ..... B63C 11/46
(52) U.S. Cl. ..... 114/315
(58) Field of Search ..... 114/315

(56) References Cited

U.S. PATENT DOCUMENTS 3,442,240 A * 5/1969 Wild et al. ..... 114/315
3,757,721 A * 9/1973 Ohishi ..... 114/315
5,704,817 A * 1/1998 Vaughn ..... 440/33
6,319,079 B1 * 11/2001 Cooper ..... 440/12.5

* cited by examiner

*Primary Examiner*—Jesus D. Sotelo
(74) *Attorney, Agent, or Firm*—Donald G. Peck; Harvey A. Gilbert

(57) ABSTRACT

An underwater swim board enables diver navigation under conditions of zero visibility. A rectangular member has a timer, depth gauge, and compass on its topside to provide a visual indication of time, depth and direction. An enhanced display module on the bottom side of the member contains a microprocessor to receive time, depth, and direction signals from separate electronic timer, depth transducer, and magnetic compass modules in the display module creates representative control signals. The display module also has a display screen and an LCD having variable backlight to vary its light intensity. The LCD receives the control signals and displays the information of the time, depth, and direction signals on the screen. A virtual image display lens mounted on the screen allows binocular viewing of the displayed information as magnified near-to-the-eye apparent screen images for a diver holding a dive mask faceplate against the screen.

21 Claims, 4 Drawing Sheets

ENHANCED DISPLAY- UNDERWATER COMBAT SWIM BOARD

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

This invention relates to an underwater display for divers. More particularly, this invention is to an enhanced display on a swim-board for divers operating under ambient conditions of zero visibility.

Military (and civilian) divers use wrist-mounted compasses, depth gauges, and timers separately or the same devices mounted together on an underwater swim board to conduct underwater navigation (magnetic compass-dead reckoning) training, and missions. These swim boards (or, combat swim boards for military applications) are preferred to using the navigational devices individually since they are lightweight, fairly low in cost, and the board can easily be held in front of the diver conducting the underwater swim exercise or mission. In other words, the diver can swim a specific magnetic heading underwater by viewing the board-mounted compass, and also monitor depth and swim times by viewing board-mounted timers and depth gauges. Auxiliary lighting is sometimes employed to enhance use at night. This auxiliary lighting could be chem-lights, light sticks, and/or those products marketed under the trademark CYALUME licensed by Omniglow Corporation, 96 Windsor Street, W. Springfield Mass. from Cytec Technology Corp.)

However, most military dive missions using swim board apparatuses are conducted under conditions of extremely poor visibility. In zero visibility conditions the diver has extreme difficulty reading the compass, or depth gauge and timers, so the diver's ability to navigate, monitor depth, and time is compromised. This limitation can effectively end the dive mission.

Thus, in accordance with this inventive concept, a need has been recognized in the state of the art for an enhanced underwater display of compass, depth, and time to permit continuation of missions under conditions of zero visibility.

OBJECTS AND SUMMARY OF THE INVENTION

An object of the invention is to provide a new capability for navigating underwater in conditions of zero visibility.

Another object of the invention is to provide an enhanced display of navigational instruments including magnetic compass, depth gauge, and timer to enable underwater navigation regardless of water visibility.

Another object of the invention is to provide an enhanced underwater display requiring minimal training for a diver to navigate, monitor depth, and time under conditions of zero visibility.

Another object of the invention is to provide an enhanced display using current standard underwater swim board format and configuration to assure successful underwater navigation regardless of visibility.

Another object of the invention is to provide a diver's swim board having an enhanced display module to enable underwater navigation regardless of visibility in the water.

These and other objects of the invention will become more readily apparent from the ensuing specification when taken in conjunction with the appended claims.

Accordingly, the present invention provides an enhanced display for underwater navigation. A housing provides protection from ambient water, and depth, timer, and heading modules adjacent the housing provide signals representative of depth, heading, and time. A microprocessor in the housing receives the representative signals to create control signals that are coupled to an LCD to display the information of the representative signals through a screen window. A virtual image display lens system is mounted in the housing to coextend adjacent on the screen window of the LCD to present the displayed information as a magnified apparent screen image to allow binocular viewing thereof.

DESCRIPTION OF THE PREFERRED EMBODIMENTS

Figure 1:
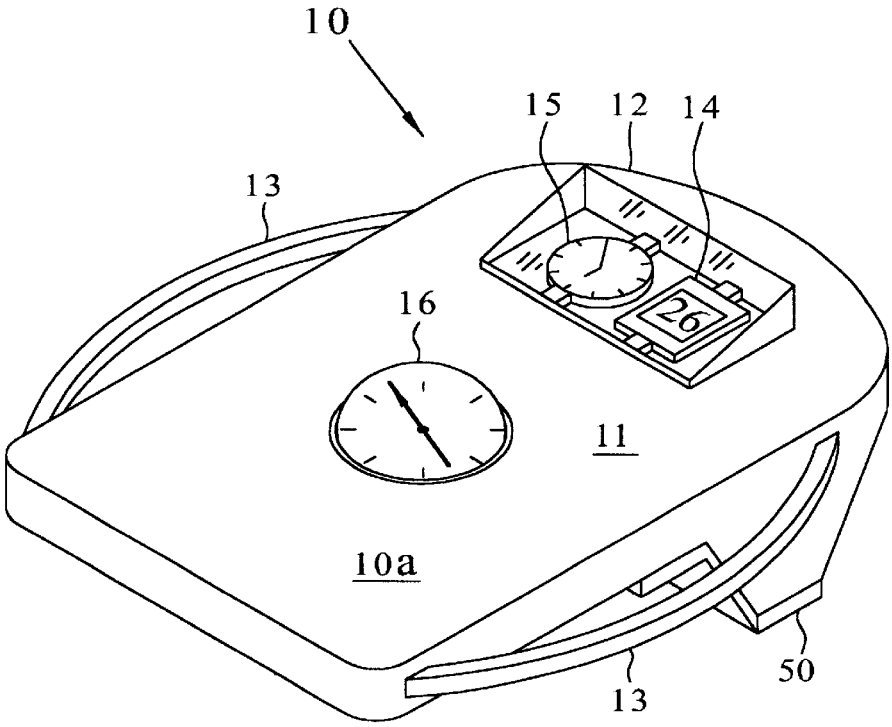
FIGS. 1, 2, and 3 are top, side, and bottom views of the underwater swim board of the invention for navigation under conditions of zero visibility.
Figure 2:
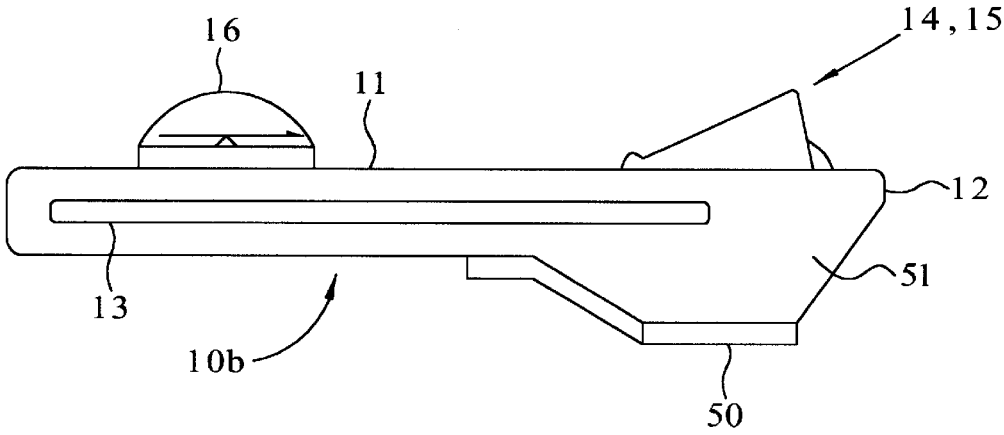
Figure 3:
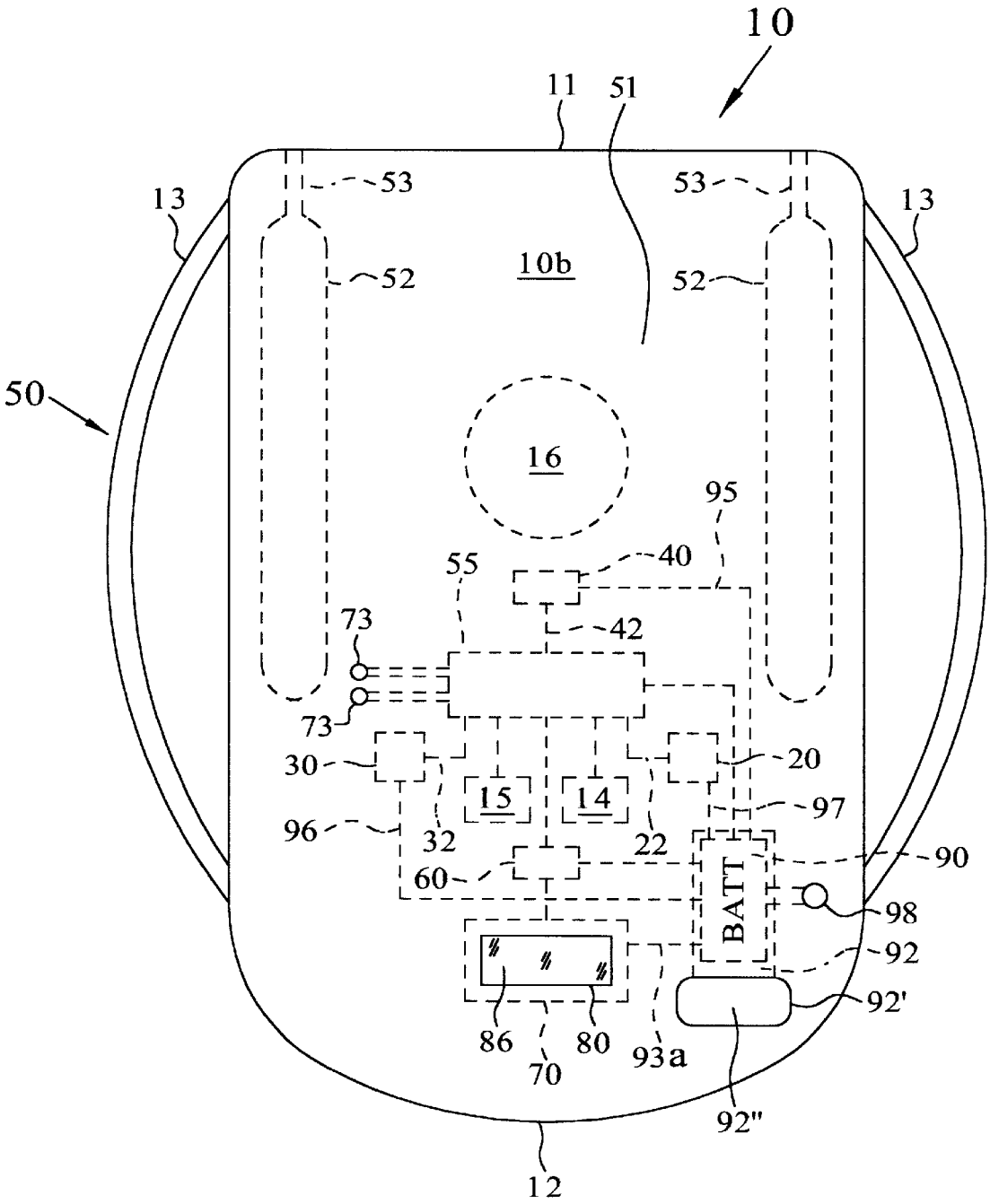

Referring to FIGS. 1, 2, and 3, underwater swim board 10 of the invention provides a capability for enhancing a display of data to permit a diver to operate successfully in water 9 under conditions of zero visibility underwater. Swim board 10 has an essentially rectangular-shaped member 11 with a rounded nose portion 12 measuring about one-by-two feet, and elongate tubular handles 13 extend along opposite sides of member 11 to allow a diver to hold onto and maneuver with swim board 10 during an undersea task. Rectangular member 11 of underwater swim board 10 can be hollow or solid and made of a rugged plastic or other strong and relatively non-corrosive material to be neutrally buoyant or only slightly negative.

An ambient pressure resistant timer 14 such as an electronic timer or diver's watch strapped on member 11 and a digital or standard analog depth gauge 15 are securely mounted adjacent to each other on the forward topside of member 11. A commercially available magnetic compass 16 is securely mounted on the top center toward the rear of member 11 from timer 14 and depth gauge 15. Timer 14, depth gauge 15, and magnetic compass 16 mounted on the topside of underwater swim board 10 are easily removable off-the-shelf components that can be replaced with upgraded models or replaced when damaged or when a diver might simply prefer one commercially available model over another.

When ambient water 9 is clear or only partially murky, timer 14, depth gauge 15, and magnetic compass 16 on the top side 10*a* of underwater swim board 10 can be directly observed by simply looking at them to visually give a diver navigational information regarding time, depth and heading. However, when conditions of zero visibility are encountered, a diver merely has to turn underwater swim board 10 over to expose its bottom side 10*b* on the bottom of rectangular member 11. This permits a diver to reliably observe the data from an electronic digital timer module 20, an electronic depth transducer module 30, and an electronic digital magnetic compass module 40 of enhanced display module 50. In other words, underwater swim board 10 of the invention gives a diver the immediate option to rely on the standard presentation of visual information from timer 14, depth gauge 15, and compass 16 or an enhanced display of information from enhanced display module 50.

Enhanced display module 50 has a rigid housing 51 that contains a number of components. Like rectangular member 11, housing 51 can be a shell-shaped structure or made from a solid potting compound such as casting resin that is molded around the components, to be described, and cured to form a protective enclosure. One or more chambers 52 having closeable ducts 53 are provided in housing 51 to allow a selective change of buoyancy or ballast for underwater swim board 10. These chambers 52 or additional chambers can extend into rectangular member 11. Sealed openings 54 and 92' for control buttons 73, 98 and cover 92" are formed in housing 51 for functions to be described.

Enhanced display module 50 has an electronic digital timer module 20 and an electronic depth transducer module 30 that are contained within the potting compound of housing 11. An electronic digital magnetic compass module 40 additionally is located in housing 11 of module 50 toward the rear of module 50 from modules 20 and 30. Electrical leads 22, 32, and 42 respectively extend from modules 20, 30, and 40 through enhanced display module 50 to a microprocessor 55 to transmit signals representative of the condition monitored from modules 20, 30, and 40. In the context of this invention microprocessor 55 includes one or more appropriate microchips on a microprocessor board having terminals coupled to receive data and power and feed responsive control signals to interconnected components.

Electronic digital timer module 20 can be any one of several commercially available, off-the-shelf bottom timers, dive watches, etc. that can rely on a crystal to accurately measure time, elapsed time, etc. and provide representative signals. Electronic depth transducer module 30 can be chosen from a goodly number of commercially available models that utilize analog or digital technology to provide signals representative of depth readings in typical feet, or feet seawater (FSW). Electronic digital magnetic compass module 40 can be selected from many suitable commercially available units using magneto-resistive, flux-gate, or magneto-inductive technologies that will provide signals representative of direction, heading, and the like. Modules 20, 30, and 40 are selected from off-the-shelf components to have the properties of speed, accuracy, power requirements, physical size, etc. to be utilized in underwater swim board 10 to successfully perform tasks in the demanding underwater environment. Accordingly, modules 20, 30, and 40 are appropriately packaged to function properly and withstand the expected physical abuses, ambient pressures, and pressure variations they will be subjected to during completion of undersea tasks.

Electrical leads 22, 32, and 42 respectively extend from modules 20, 30, and 40 through member 11 to transmit signals representative of the condition monitored from the modules. It may be desirable to fabricate modules 20, 30, and 40 to include components that provide analog output signals that are representative of monitored phenomena. In this case analog-to-digital converters (not shown) also can be included as part of modules 20, 30, and 40 to convert the representative signals to digital form for processing in microprocessor 55, or microprocessor 55 can be modified to include appropriate A-to-D converters.

Figure 4:
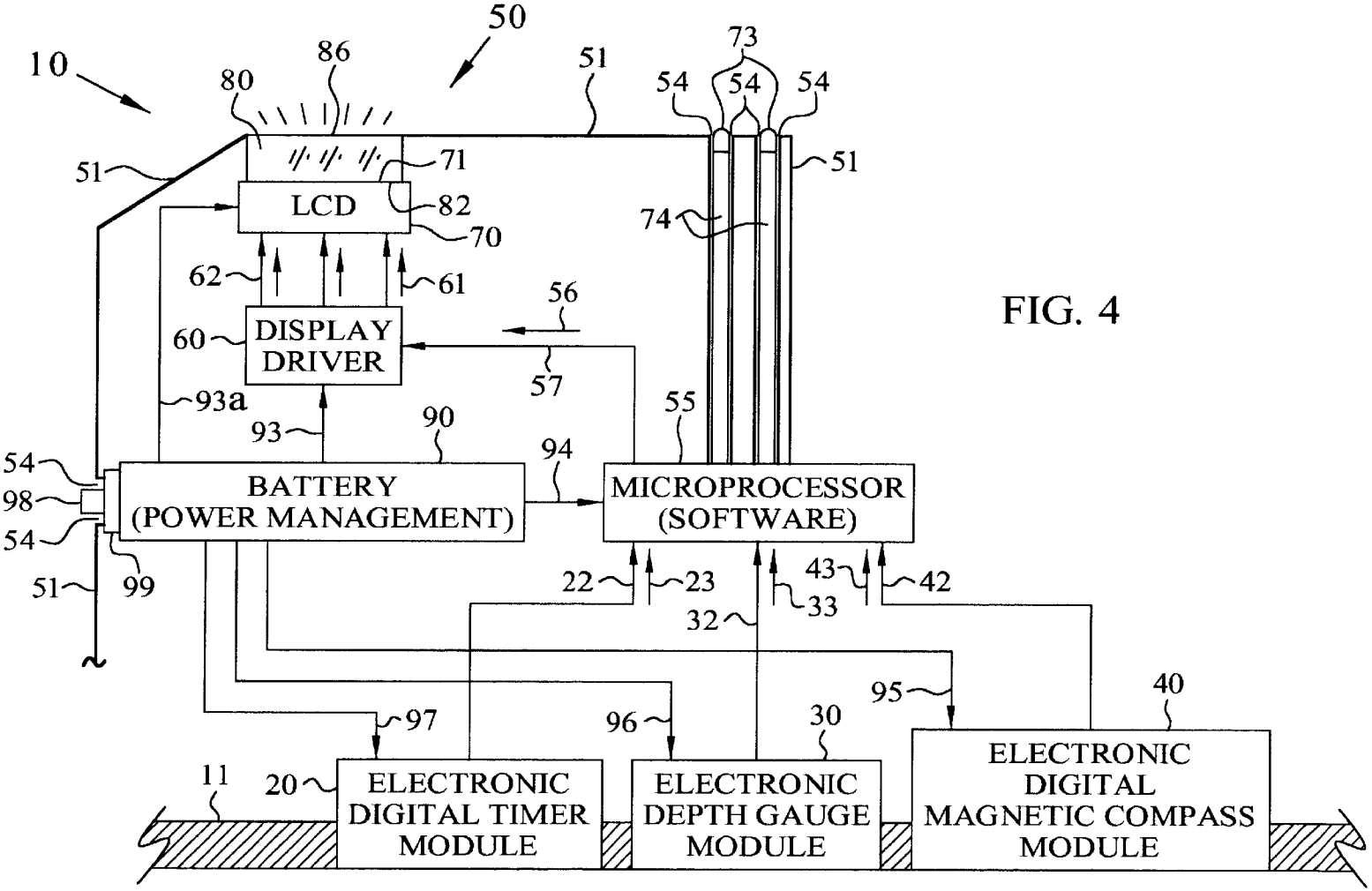
FIG. 4 is a schematic showing of the enhanced display of the invention.

Referring additionally to FIG. 4, enhanced display module 50 has microprocessor 55 in housing 51 that is connected to modules 20, 30, and 40 via leads 22, 32, and 42. Microprocessor 55 receives information signals shown as arrows 23, 33, and 43 on leads 22, 32, and 42 from electronic digital timer module 20, electronic depth transducer module 30, and electronic digital magnetic compass module 40, respectively. Microprocessor 55 includes at least one state-of-the-art microchip that is fabricated, programmed, and interconnected in accordance with what is well known in the art to receive information signals 23, 33, and 43 and appropriately process them. Microprocessor 55 then creates control signals shown as arrow 56 representative of the information signals, and feeds control signals 56 over lead 57 to a display driver 60. The software embedded into microprocessor 55 controls all the various functions to receive and process information signals including, but not limited to taking data from sensors, interpreting & formatting it, talking to the display driver, managing the power, etc. This software can be appropriately modified via an access provide through sealed opening 92' as elaborated on below.

Upon receiving control signals 56 from microprocessor 55, display driver 60 generates responsive driver signals shown as arrows 61 that are coupled over lead 62 to liquid crystal display (LCD) 70. LCD 70 is an off-the-shelf transmissive display that is widely used to display the information of data and other symbols through a top screen window 71. A transmissive display mode of operation is routinely used in liquid crystal display technology and relies on a backlight source of light (a light source behind a display screen) to display characters. This transmissive feature of LCD 70 means that it requires and has its own backlight light source, schematically shown as bulb 72, to illuminate LCD 70 so that information can be seen. LCD 70 has alphanumeric segments much like the well-known digital watch and/or graphic symbols like circles, rosettes, arrows, etc. Two illumination control buttons 73 have control leads 74 that extend through sealed openings 54 in housing 51 and are connected to microprocessor 55 to vary the intensity of light radiated from light source 72 via display driver 60. Pressing one button 73 causes light source 72 to increase its intensity, and pressing the other button 73 decreases the intensity of light source 72. Having variable intensity controls 73 for light source 72 in enhanced display module 50 is desirable and important since a diver may need to change illumination levels for optimum viewing, depending on ambient conditions (daylight, night, clear water, murky water). Controlling, or rather, reducing the levels of light radiated from source 72 is also desirable when a diver is to remain unnoticed during certain tasks.

Enhanced display module 50 has a battery supply 90 to provide electrical power for underwater swim board 10. Battery power supply 90 is at least one battery contained in a separate cavity 92 in housing 11 to prevent inadvertent leaking of chemicals that might otherwise damage the other modules and components. A sealed opening 92' for cavity 92 extends through housing 11 to enable changing of batteries with fresh batteries as they are drained of power. Access to microprocessor 55 and other constituents of enhanced display module 50 may be made by removing cover 92" from sealed opening 92' to allow reprogramming and/or change of software in microprocessor 55 or repair or removal and replacement of other constituents as needed.

Battery supply 90 is connected to supply electrical power to display driver 60 through power lead 93, to LCD 70 through power lead **93*a*, to microprocessor 55 through power lead 94, to electronic digital magnetic compass module 40 through power lead 95, to electronic depth transducer module 30 through power lead 96 and to electronic digital timer module 20 through power lead 97. An actuation button 98 of ON-OFF switch 99 extends through another opening 54 and is connected to power supply 90. Actuation button 98 enables a diver to switch electrical power from power supply 90 through the power leads when the enhanced viewing capability of enhanced display module 50** is needed.

Figure 5:
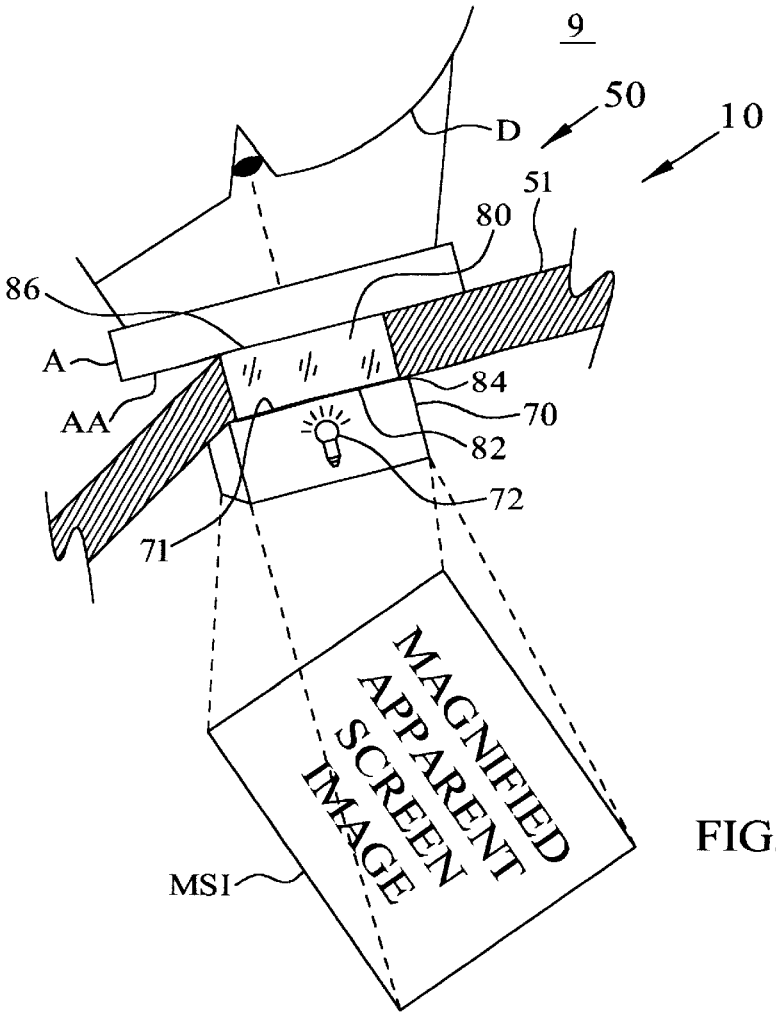
FIG. 5 is side view showing details of a diver placing the faceplate of a diving mask against the lens system of the enhanced display module to view a display for underwater navigation under conditions of zero visibility.
Figure 6:
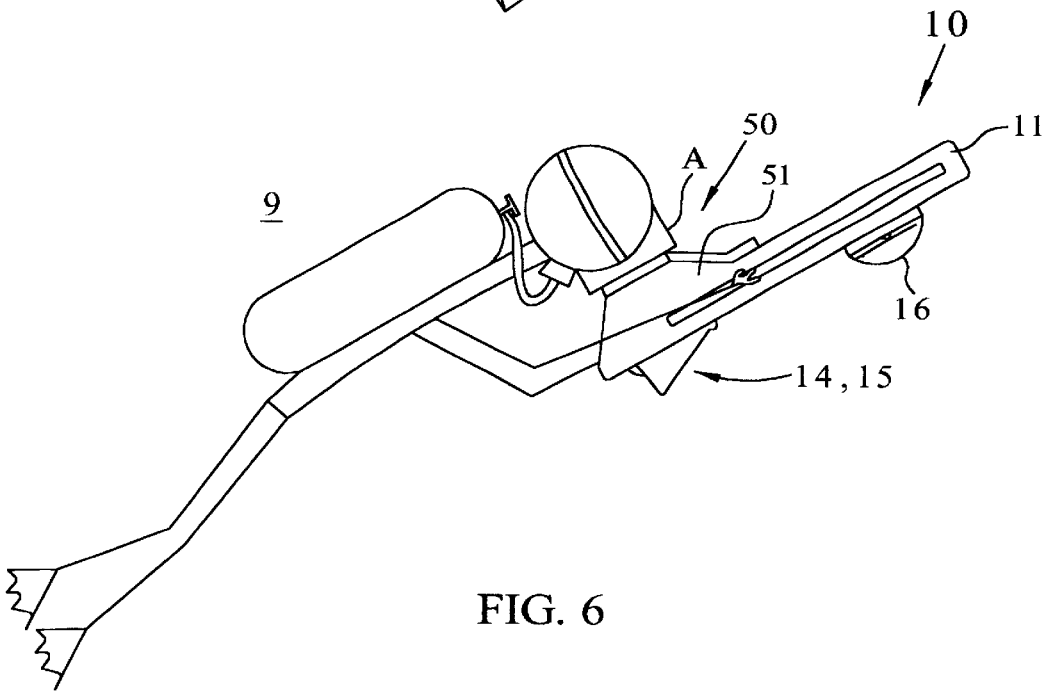
FIG. 6 is a side view of a diver using the enhanced display module of the underwater swim board of the invention.

Referring additionally to FIGS. 5 and 6, a diver D wearing a dive mask A is able to clearly see the information on LCD 70 through screen window 71. This capability is due to the inclusion of a virtual image display lens system 80 that is mounted on housing 51. Lens system 80 has an inner surface 82 to coextend adjacent to screen window 71.

Virtual image display lens systems are well known in the art as lens systems that make an object or display that is "near-to-the-eye" appear to be further away and highly magnified. This near-to-the-eye viewing capability gives an observer, such as diver D a binocular view of the display as it would otherwise appear further away from the eyes and under a higher magnification. Virtual image display lens systems use commercially available optics such as those employed in head-mounted display systems and can be lens-based systems, free prism-based systems, or mirror -based systems that are very compact and flat in form. These systems can produce extremely high magnification for micro-displays (or miniature LCDs such as LCD 70) that cannot be read with the unaided eye since they are so small. Companies producing such optical systems include Olympus Inc.; I-O Display Systems, LLC; and Dae Yang.

Accordingly, virtual image display lens system 80 can be selected from the wide variety of suitable off-the-shelf systems to magnify and present a virtual image. This virtual image of the magnified display screen appears to be approximately 10 to 12 inches away in front of faceplate AA of the diver's facemask A as a magnified apparent screen image MSI.

Diver D places faceplate AA of mask A to abut, or lie adjacent the outer surface 86 of lens system 80 and is able to have binocular viewing of the depth, heading, and timing information displayed on LCD 70. This close contact, or contiguous fitting to faceplate AA by outer surface 86 allows only a small, insignificant amount of possibly murky ambient water 9 to come between them, and, consequently, between the diver's eyes and the information transmitted through LCD 70. If viewing is not clearly enough defined or the display is too bright for clandestine operations, a diver may actuate control buttons 73 until the display brightness through screen 71 is optimized. To view this virtual image binocular display on LCD 70 diver D must place faceplate AA of facemask A against the display window (outer surface 86 of lens system 80) to see the magnified virtual image display. This placement enables viewing in zero visibility conditions (since only a very small amount of water is between the dive mask and the display window), and it is the only way diver D can see/view the information on display screen 71. Even in clear water if diver D holds mask A away from enhanced display module 50, diver D won't be able to see the virtual image at all because of the near-to-the-eye viewing feature of lens system 80.

The diver is able to swim and navigate long distances in murky water 9 and may change directions to a series of different headings. Throughout this procedure although ambient visibility may be extremely poor, or even nonexistent, accurate navigation is possible. The diver grasps handles 13 of underwater swim board 10 and holds faceplate AA on outer surface 86 of enhanced display module 50. Enhanced readings of data of time, depth and heading can be clearly perceived as the diver continues to swim to the destination.

Having the teachings of this invention in mind, modifications and alternate embodiments of underwater swim board 10 may be adapted without departing from the scope of the invention. Its uncomplicated, compact design lends itself to numerous modifications to permit its reliable use in hostile and demanding marine environments. Underwater swim board 10 can be made larger or smaller in different shapes and fabricated from a wide variety of materials to assure resistance to corrosion, sufficient strength, and long term reliable operation under different operational requirements.

The disclosed components and their arrangements as disclosed herein, all contribute to the novel features of this invention. Underwater swim board 10 is a rugged, compact, cost-effective, diver's tool that helps assure completion of the task irrespective of conditions of visibility in hostile marine environments. Therefore, underwater swim board 10, as disclosed herein is not to be construed as limiting, but rather, is intended to be demonstrative of this inventive concept.

It should be readily understood that many modifications and variations of the present invention are possible within the purview of the claimed invention. It is to be understood that within the scope of the appended claims the invention may be practiced otherwise than as specifically described.

We claim:

1. An enhanced display module for underwater viewing comprising:

housing means for providing protection from ambient water;

means in said housing for coupling signals representative of depth, heading, and time;

means in said housing means coupled to receive said representative signals for creating control signals;

means in said housing means responsive to said control signals for displaying information of said representative signals through a screen window; and a virtual image display lens system mounted in said housing means to coextend adjacent on said screen window of said information displaying means to present said displayed information as a magnified apparent screen image to allow binocular viewing thereof.

2. The module of claim 1 further comprising:

a means coupled between said control signal creating means and said information displaying means displaying for driving said information displaying means, said driving means being responsive to said control signals to generate driving signals to drive said displaying means.

3. The module of claim 2 further comprising:

means connected to said representative signal coupling means, said control signal creating means, said information displaying means, and said driving means for supplying power thereto.

4. The module of claim 3 further comprising:

an OFF-ON switch connected to said power supplying means and extending through said housing means to permit selective actuation thereof.

5. The module of claim 4 further comprising:

means coupled to said control signal creating means and extending through said housing means for varying light intensity of said information displaying means.

6. The module of claim 5 wherein said control signals creating means is comprised of a microprocessor, and said information displaying means is comprised of an LCD.

7. The module of claim 6 wherein said driver means is comprised of a display driver, and said power supply means is comprised of at least one battery.

8. The module of claim 7 wherein said representative signals coupling means is comprised of leads coupling signals representative of depth, heading, and time from a depth transducer module, magnetic compass module and timer module in said housing means.

9. The module of claim 8 wherein said housing is provided with chambers to provide buoyancy and ballast.

10. The module of claim 9 wherein said virtual image display lens system has an outer surface to contiguously lie adjacent a faceplate of a diver's mask to allow only a small amount of ambient water to come between them.

11. The module of claim 10 wherein said varying means includes control buttons coupled to said microprocessor to vary the light intensity of a light source of said LCD.

12. An underwater swim board comprising:

a rectangular member;

a timer mounted on said rectangular member to provide a visual indication representative of time;

a depth gauge mounted on said rectangular member to provide a visual indication representative of depth;

a magnetic compass mounted on said rectangular member to provide a visual indication representative of magnetic heading;

a housing mounted on said rectangular member;

a digital electronic timer module mounted in said housing to provide digital signals representative of time;

a electronic depth transducer in said housing to provide signals representative of depth;

a digital electronic compass module in said housing to provide signals representative of magnetic heading;

a microprocessor coupled to receive said time signals, depth signals and magnetic heading signals to create control signals;

an LCD connected to receive said control signals from said microprocessor having a screen window to display information of said time signals, depth signals and direction signals; and a virtual image display lens system mounted to coextend adjacent on said screen window of said information displaying means to present said displayed information as a magnified apparent screen image to allow binocular viewing thereof.

13. The underwater swim board of claim 12 further comprising:

a display driver connected to said microprocessor and said LCD, said display driver being responsive to said control signals to generate driving signals to drive said LCD.

14. The underwater swim board of claim 13 wherein said housing is mounted on said rectangular member to contain and protect said timer module, said depth gauge module, said compass module, said microprocessor, said display driver, said LCD, and said virtual image display lens system and present an outer surface on said virtual image display lens system.

15. The underwater swim board of claim 14 further comprising:

at least one battery in said housing connected to supply power to said timer module, depth gauge module, compass module, microprocessor, display driver, LCD, and virtual image display lens system, said battery having an OFF-ON switch extending through said housing to provide selective activation thereof.

16. The underwater swim board of claim 15 wherein said microprocessor has control buttons extending through said housing and being coupled to a variable backlight to vary the light intensity of said LCD.

17. The underwater swim board of claim 16 wherein said virtual image display lens system has said outer surface to contiguously lie adjacent to a faceplate of a diver's mask to allow only a small amount of ambient water to come between them.

18. The underwater swim board of claim 17 wherein said timer module, depth gauge module, compass module, microprocessor, display driver, LCD, virtual image display lens system, and battery are contained in said housing as an enhanced display module having said outer surface thereon to permit viewing of information on said LCD under conditions of zero visibility in ambient water.

19. The underwater swim board of claim 18 wherein said enhanced display module is on one side of said rectangular member and said timer, depth gauge, and magnetic compass are on the other side of said rectangular member.

20. The module of claim 19 wherein said housing is provided with chambers to provide buoyancy and ballast.

21. An underwater swim board for a diver to permit navigation under conditions of zero visibility in water comprising:

a rectangular member having a top side and bottom side, said rectangular member being provided with chambers to provide buoyancy and ballast;

a timer mounted on said top side of said rectangular member to provide a visual indication representative of time;

a depth gauge mounted on said top side of said rectangular member to provide a visual indication representative of depth;

a magnetic compass mounted on said top side of said rectangular member to provide a visual indication representative of magnetic heading;

an enhanced display module mounted on said bottom side of said rectangular member including:

a housing mounted on said bottom side of said rectangular member;

a digital electronic timer module mounted on said bottom side of said rectangular member in said housing of said enhanced display module to provide signals on a lead representative of time;

an electronic depth transducer module mounted on said bottom side of said rectangular member in said housing of said enhanced display module to provide signals on a lead representative of depth;

a digital electronic magnetic compass module mounted on said bottom side of said rectangular member in said housing of said enhanced display to provide signals on a lead representative of magnetic heading;

a microprocessor module mounted on said bottom side of said rectangular member in said housing of said enhanced display coupled to receive said time signals, depth signals and, magnetic heading signals to create control signals;

an LCD module mounted on said bottom side of said rectangular member in said housing of said enhanced display connected to receive said control signals from said microprocessor having a screen window to display information of said time signals, depth signals and magnetic heading signals, said microprocessor having control buttons extending through said housing and coupled to a variable backlight to vary the light intensity of said LCD;

a display driver module mounted on said bottom side of said rectangular member in said housing of said enhanced display connected to said microprocessor and said LCD, said display driver being responsive to said control signals to generate driving signals to drive said LCD;

a virtual image display lens system module mounted on said bottom side of said rectangular member in said housing of said enhanced display, said virtual image display lens system being mounted to coextend adjacent on said screen window of said information displaying means having an outer surface to present said displayed information as a magnified apparent screen image to allow binocular viewing thereof, said virtual image display lens system having said outer surface to contiguously lie adjacent a faceplate of a diver's mask to allow only a small amount of ambient water to come between them; and at least one battery module mounted on said bottom side of said rectangular member in said housing of said enhanced display having power leads connected to supply power to said timer module, depth transducer module, magnetic compass module, microprocessor, display driver, LCD, and virtual image display lens system, said battery having an OFF-ON switch extending through said housing to provide selective activation thereof.

* * * * *